US007367426B1

(12) United States Patent
Gutierrez

(10) Patent No.: US 7,367,426 B1
(45) Date of Patent: May 6, 2008

(54) EZ CHANGE OIL

(76) Inventor: Robert Gutierrez, 17200 Donmetz St., Granada Hills, CA (US) 91344

( * ) Notice: Subject to any disclaimer, the term of this patent is extended or adjusted under 35 U.S.C. 154(b) by 739 days.

(21) Appl. No.: 10/850,603

(22) Filed: May 20, 2004

Related U.S. Application Data

(60) Provisional application No. 60/472,206, filed on May 21, 2003.

(51) Int. Cl.
*F16C 3/14* (2006.01)

(52) U.S. Cl. ..... 184/1.5; 141/98

(58) Field of Classification Search ..... 184/1.5; 141/98, 1
See application file for complete search history.

(56) References Cited

U.S. PATENT DOCUMENTS 3,743,053 A * 7/1973 Kuklewicz ..... 184/1.5
3,921,759 A * 11/1975 Bottum ..... 184/1.5
4,299,307 A 11/1981 Scott
5,002,154 A * 3/1991 Chen ..... 184/1.5
5,070,831 A * 12/1991 Yunick ..... 123/196 A
5,148,785 A * 9/1992 Sendak ..... 123/196 R
5,435,413 A * 7/1995 Schoenborn ..... 184/1.5
5,450,924 A * 9/1995 Tseng ..... 184/1.5
5,881,840 A 3/1999 Mize
6,003,635 A * 12/1999 Bantz et al. ..... 184/1.5
6,102,159 A * 8/2000 Rogate ..... 184/1.5
6,138,722 A * 10/2000 Willingham ..... 141/98
6,216,573 B1 * 4/2001 Moutafis et al. ..... 83/177
6,484,744 B1 * 11/2002 Tseng ..... 137/205
6,655,426 B2 * 12/2003 Shevela ..... 141/382

* cited by examiner

*Primary Examiner*—David M. Fenstermacher

(57) ABSTRACT

An oil extraction apparatus for extracting oil from the oil pan of a vehicle is provided. The oil extraction apparatus includes a pump assembly operationally coupled to a power source of a vehicle. An inlet port assembly operationally coupled to the pump assembly. The inlet port assembly is in fluid communication with an oil pan of the vehicle. The pump assembly is for drawing oil from the oil pan of the vehicle through the inlet port assembly when the pump assembly is actuated. An outlet port assembly operationally coupled to the pump assembly. The outlet port assembly is in fluid communication with a disposal container. The pump assembly is for forcing oil drawn through the inlet port assembly through the outlet port assembly to be deposited in the disposal container for disposal of the oil.

14 Claims, 2 Drawing Sheets

EZ CHANGE OIL

I. CROSS-REFERENCE TO RELATED APPLICATIONS

This application claims the benefit of U.S. Provisional Application No. 60/472,206, filed May 21, 2003.

II. BACKGROUND OF THE INVENTION

The present invention relates to oil extraction systems and more particularly pertains to a new oil extraction apparatus for extracting oil from the oil pan of a vehicle.

III. DESCRIPTION OF THE PRIOR ART

The use of oil extraction systems is known in the prior art. More specifically, oil extraction systems heretofore devised and utilized are known to consist basically of familiar, expected and obvious structural configurations, notwithstanding the myriad of designs encompassed by the crowded prior art which have been developed for the fulfillment of countless objectives and requirements.

Illustrative examples of such devices include: U.S. Pat. No. 4,299,307; U.S. Pat. No. 5,148,785; and U.S. Pat. No. 5,881,840.

In these respects, the oil extraction apparatus according to the present invention substantially departs from the conventional concepts and designs of the prior art, and in so doing provides an apparatus primarily developed for the purpose of extracting oil from the oil pan of a vehicle.

IV. SUMMARY OF THE INVENTION

In view of the foregoing disadvantages inherent in the known types of oil extraction systems now present in the prior art, the present invention provides a new oil extraction apparatus construction wherein the same can be utilized for extracting oil from the oil pan of a vehicle.

To attain this, the present invention generally comprises a pump assembly being designed for being operationally coupled to a power source of a vehicle. An inlet port assembly being operationally coupled to the pump assembly. The inlet port assembly is designed for being in fluid communication with an oil pan of the vehicle. The pump assembly is designed for drawing oil from the oil pan of the vehicle through the inlet port assembly when the pump assembly is actuated. An outlet port assembly being operationally coupled to the pump assembly. The outlet port assembly is designed for being in fluid communication with a disposal container. The pump assembly is designed for forcing oil drawn through the inlet port assembly through the outlet port assembly to be deposited in the disposal container for disposal of the oil.

There has thus been outlined, rather broadly, the more important features of an oil extraction apparatus for extracting oil from an engine in order that the detailed description thereof that follows may be better understood, and in order that the present contribution to the art may be better appreciated. There are additional features of the oil extraction apparatus for extracting oil from an engine that will be described hereinafter and which will form the subject matter of the claims appended hereto.

In this respect, before explaining at least one embodiment of the oil extraction apparatus for extracting oil from an engine in detail, it is to be understood that the oil extraction apparatus for extracting oil from an engine is not limited in its application to the details of construction and to the arrangements of the components set forth in the following description or illustrated in the drawings. The oil extraction apparatus for extracting oil from an engine is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present oil extraction apparatus for extracting oil from an engine. It is important, therefore, that the claims be regarded as including such equivalent constructions insofar as they do not depart from the spirit and scope of the present invention.

It is therefore an object of present invention is to provide an apparatus that takes used oil from a vehicle that needs to be removed from the vehicle without have access to the bottom of the vehicle.

It is another object of the present invention to provide an oil extraction apparatus for extracting oil from an engine which has all of the advantages of the prior art and none of the disadvantages.

It is another object of the present invention to provide an oil extraction apparatus for extracting oil from an engine which may be easily and efficiently manufactured and marketed.

It is another object of the present invention to provide an oil extraction apparatus for extracting oil from an engine which is of durable and reliable construction.

It is yet another object of the present invention to provide an oil extraction apparatus for extracting oil from an engine which is economically affordable and available for relevant market segment of the purchasing public.

Other objects, features and advantages of the present invention will become more readily apparent from the following detailed description of the preferred embodiment when considered with the attached drawings and appended claims.

V. BRIEF DESCRIPTION OF THE DRAWINGS

VI. DESCRIPTION OF THE PREFERRED EMBODIMENT

Figure 1:
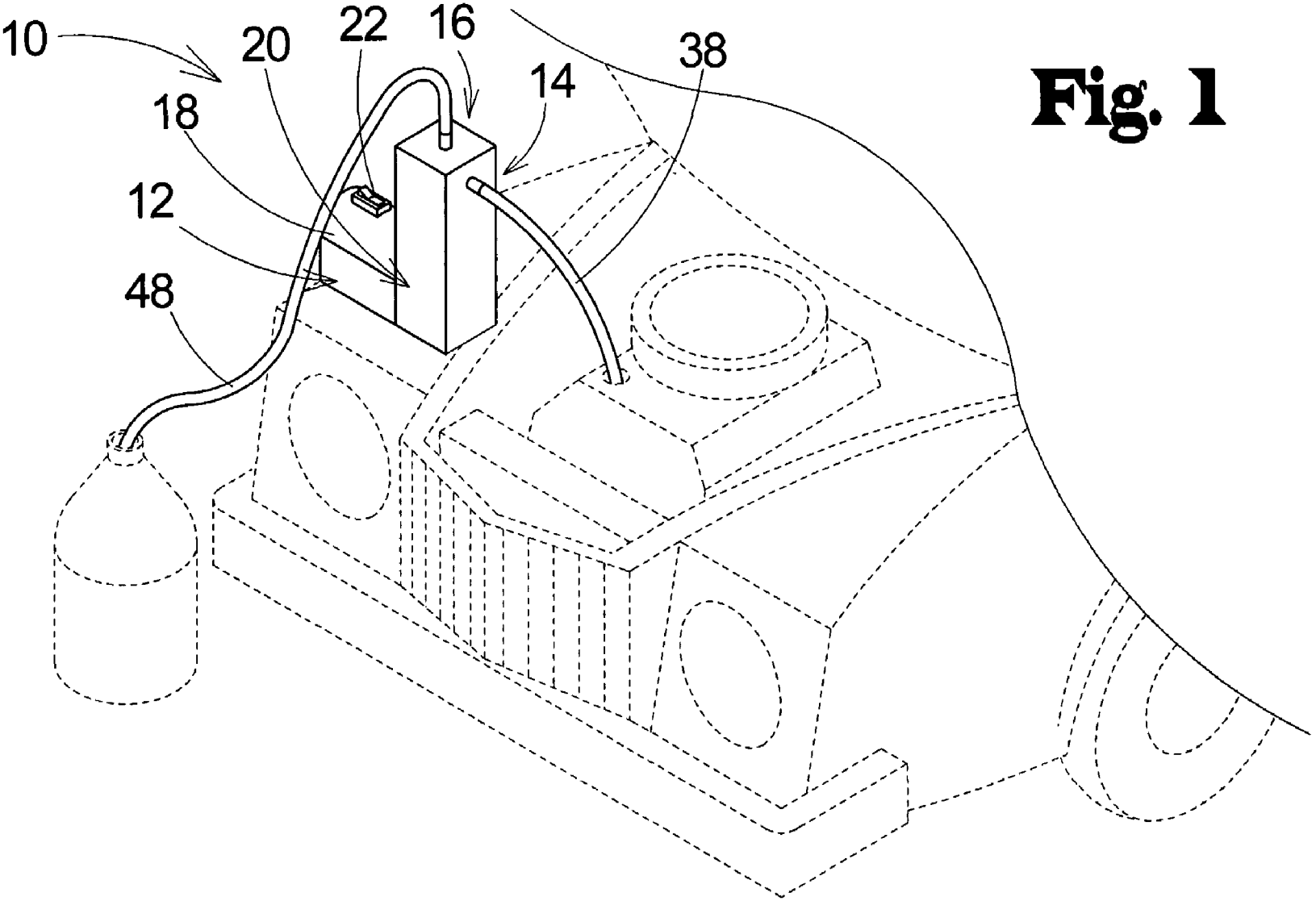
FIG. 1 is a schematic side view of a new oil extraction apparatus according to the present invention.
Figure 2:
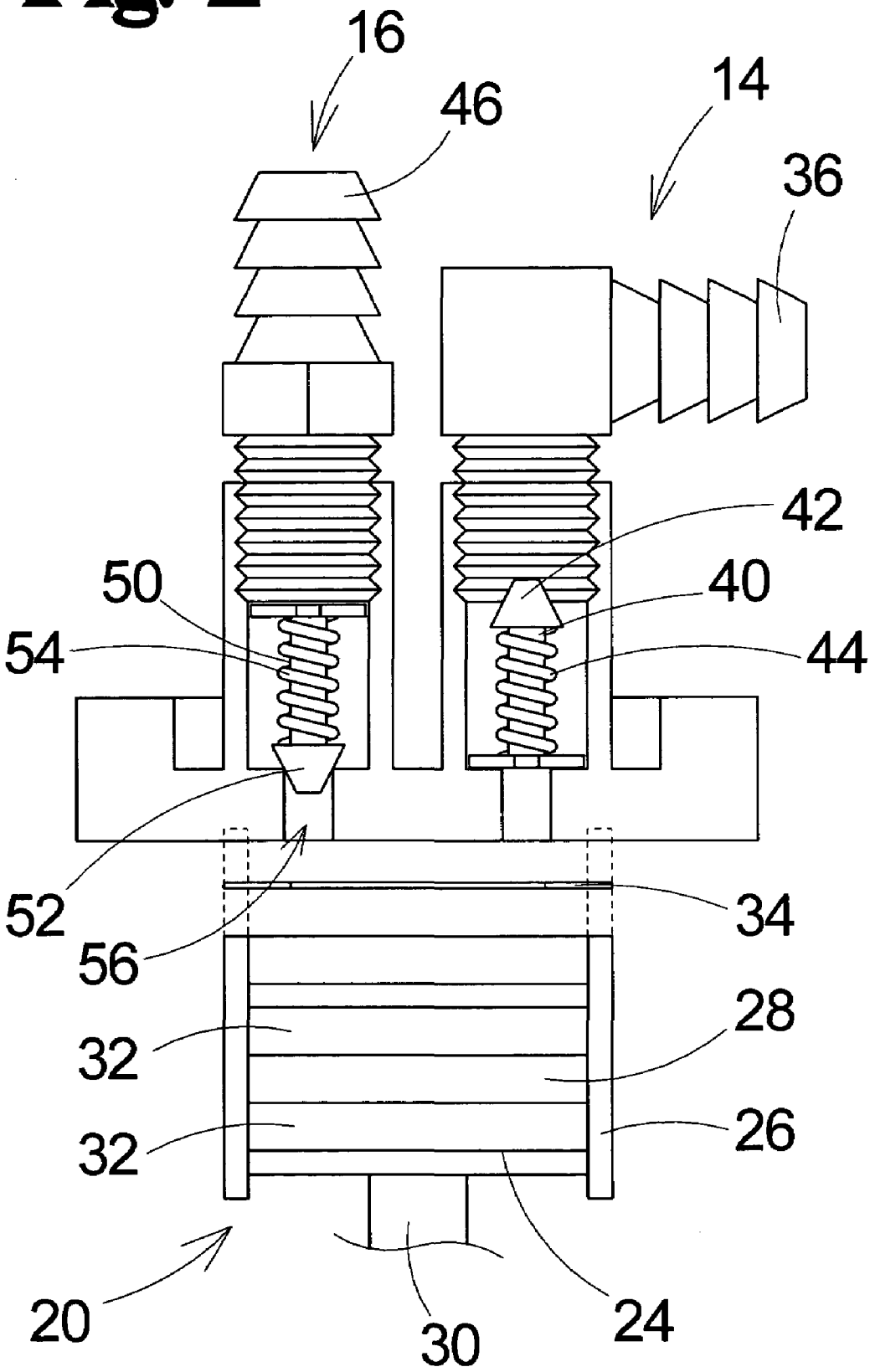
FIG. 2 is a cross-sectional view of the inlet port assembly, the outlet port assembly and the piston assembly of the present invention.

With reference now to the drawings, and in particular to FIGS. 1 and 2 thereof, a new oil extraction apparatus embodying the principles and concepts of the present invention and generally designated by the reference numeral 10 will be described.

As best illustrated in FIGS. 1 and 2, the oil extraction apparatus 10 generally comprises a pump assembly 12 being designed for being operationally coupled to a power source of a vehicle whereby the power source supplies power to the pump assembly 12 to actuate the pump assembly 12.

An inlet port assembly 14 being operationally coupled to the pump assembly 12 whereby the pump assembly 12 is in fluid communication with the inlet port assembly 14. The inlet port assembly 14 is designed for being in fluid communication with an oil pan of the vehicle. The pump assembly 12 is designed for drawing oil from the oil pan of the vehicle through the inlet port assembly 14 when the pump assembly 12 is actuated.

An outlet port assembly 16 being operationally coupled to the pump assembly 12 whereby the pump assembly 12 is in fluid communication with the outlet port assembly 16. The outlet port assembly 16 is designed for being in fluid communication with a disposal container. The pump assembly 12 is designed for forcing oil drawn through the inlet port assembly 14 through the outlet port assembly 16 to be deposited in the disposal container for disposal of the oil.

The pump assembly 12 comprises a motor member 18 and a piston assembly 20. The motor member 18 is designed for being operationally coupled to the power source of the vehicle. The piston assembly 20 is operationally coupled to the inlet port assembly 14 and the outlet port assembly 16 whereby the piston assembly 20 is in fluid communication with the outlet port assembly 16 and the inlet port assembly 14. The motor member 18 is operationally coupled to the piston assembly 20 whereby the motor member 18 actuates the piston assembly 20 to draw oil from the oil pan of the vehicle into the disposal container.

The pump assembly 12 comprising a switch member 22. The switch member 22 is operationally coupled to the motor member 18 whereby the switch member 22 is designed for being operationally coupled between the motor member 18 and the power source of the vehicle. The switch is for controlling the flow of power to the motor member 18 when the switch member 22 is actuated by the user.

The piston assembly 20 comprises piston member 24 and cylinder member 26. The cylinder member 26 is coupled to the outlet port assembly 16 and the inlet port assembly 14 whereby the cylinder member 26 is in fluid communication with the outlet port assembly 16 and the inlet port assembly 14. The piston member 24 is slidably positioned in the cylinder member 26. The piston member 24 is operationally coupled to the motor member 18 whereby the motor member 18 oscillates the piston member 24 along the length if the cylinder member 26. The piston member 24 is designed for creating a vacuum in the cylinder member 26 to draw the oil through the inlet port assembly 14 and force the oil through the outlet port assembly 16 during an oscillation of the piston member 24.

The piston member 24 comprises a head portion 28 and a rod portion 30. The rod portion 30 is operationally coupled to the motor member 18. The head portion 28 is positioned in the cylinder member 26. The rod portion 30 is operationally coupled to the head portion 28 whereby the rod portion 30 slides the head portion 28 with respect to the cylinder member 26 when the rod portion 30 is actuated by the motor member 18.

The piston member 24 comprises a pair of seal portions 32. One of the seal portions 32 is coupled to the head portion 28 opposite the other one of the seal portions 32. The seal portions 32 engage the cylinder member 26 to inhibit oil leaking around the head portion 28 of the piston member 24 when the oil is being drawn through the inlet port assembly 14 and expelled through the outlet port assembly 16.

A gasket member 34 being selectively positioned between the cylinder member 26, the outlet port assembly 16 and the inlet port assembly 14 when the cylinder member 26 is coupled to the inlet port assembly 14 and the outlet port assembly 16. The gasket member 34 being designed for inhibiting oil from leaking out of the cylinder member 26 between the cylinder member 26, the outlet port assembly 16 and the inlet port assembly 14.

The inlet port assembly 14 comprises an inlet nipple portion 36 and an inlet conduit 38. The inlet conduit 38 is selectively coupled to the inlet nipple portion 36. The inlet conduit 38 is designed for being inserted into the oil pan of the vehicle through an oil dipstick tube of the vehicle whereby the inlet conduit 38 allows oil from the oil pan to be drawn into the inlet nipple portion 36.

The inlet port assembly 14 comprises an inlet valve member positioned adjacent the inlet nipple portion 36. The inlet valve member 40 is designed for restricting oil being drawn through the inlet nipple portion 36 when the pump assembly 12 is forcing oil through the outlet port assembly 16. The inlet valve is designed for permitting oil to be drawn through the inlet nipple portion 36 when the pump assembly 12 is drawing oil from the oil pan of the vehicle.

The inlet valve member 40 comprises an inlet seal member 42 and an inlet biasing member 44. The inlet biasing member 44 biases the inlet seal member 42 against the inlet nipple portion 36 to inhibit oil from flowing through the inlet nipple portion 36 when the pump assembly 12 is expelling oil through the outlet port assembly 16. The inlet seal member 42 is forced away from the inlet nipple portion 36 to allow oil to flow through the inlet nipple portion 36 from the oil pan of the vehicle when the pump assembly 12 is drawing oil from the oil pan of the vehicle.

The outlet port assembly 16 comprises an outlet nipple portion 46 and an outlet conduit 48. The outlet conduit 48 is selectively coupled to the outlet nipple portion 46. The outlet conduit 48 is designed for being inserted into the disposal container whereby the outlet conduit 48 allows oil from the oil pan to be expelled into the disposal container through the outlet nipple portion 46.

The outlet port assembly 16 comprises an outlet valve member 50 positioned adjacent the outlet nipple portion 46. The outlet valve member 50 is designed for restricting oil being expelled through the outlet nipple portion 46 when the pump assembly 12 is drawing oil through the inlet port assembly 14. The outlet valve is designed for permitting oil to be expelled through the outlet nipple portion 46 when the pump assembly 12 is expelling oil from the pump assembly 12.

The outlet valve member 50 comprises an outlet seal member 52 and an outlet biasing member 54. An outlet aperture 56 of the outlet port assembly 16 is positioned between the outlet nipple portion 46 and the pump assembly 12 to permit fluid communication between the pump assembly 12 and the outlet nipple portion 46. The outlet biasing member 54 biases the outlet seal member 52 against the outlet aperture 56 of the outlet port assembly 16 to inhibit oil from flowing through the outlet nipple portion 46 when the pump assembly 12 is drawing oil through the inlet port assembly 14. The outlet seal member 52 is forced away from the outlet aperture 56 to allow oil to flow through the outlet nipple portion 46 to the disposal container when the pump assembly 12 is expelling oil drawn from the oil pan of the vehicle.

In use, the user inserts the inlet conduit 38 into the oil dipstick tube and into the oil pan of the vehicle. The inlet conduit 38 is then coupled to the inlet nipple portion 36 of the inlet port assembly 14. The outlet conduit 48 is then extended into the disposal container and coupled to the outlet nipple portion 46. The motor member 18 is then operationally coupled to the power source of the vehicle, such as the battery, and the switch member 22 is actuated. The pump assembly 12 draws the oil from the oil pan of the vehicle and deposits the oil in the disposal container to be disposed of by the user permitting the user to change the oil in a vehicle without having to get under the vehicle.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What I claim as my invention is:

1. An oil extraction apparatus for extracting oil from an engine, the oil extraction apparatus comprising:

a pump assembly operationally coupled to a power source of a vehicle such that the power source supplies power to said pump assembly to actuate said pump assembly, an inlet port assembly operationally coupled to said pump assembly such that said pump assembly is in fluid communication with said inlet port assembly, said inlet port assembly in fluid communication with an oil pan of the vehicle, said pump assembly drawing oil from the oil pan of the vehicle through said inlet port assembly when said pump assembly is actuated, an outlet port assembly coupled to said pump assembly such that said pump assembly is in fluid communication with said outlet port assembly, said outlet port assembly in fluid communication with a disposal container, said pump assembly forcing oil drawn through said inlet port assembly through said outlet port assembly to be deposited in the disposal container for disposal of the oil, an inlet valve member restricting oil drawn through the inlet port assembly when said pump assembly is forcing oil through said outlet port assembly, said inlet valve permitting oil to be drawn through said inlet port assembly when said pump assembly is drawing oil from the oil pan of the vehicle, and an outlet valve member restricting oil expelled through the outlet port assembly when said pump assembly is drawing oil through said inlet port assembly, said outlet valve permitting oil to be expelled through said outlet port assembly when said pump assembly is expelling oil from said pump assembly;

wherein both the inlet valve member and the outlet valve member have a trapezoidal cross-sectional configuration.

2. The oil extraction apparatus as set forth in claim 1 wherein said pump assembly comprises a motor member and a piston assembly, said motor member operationally coupled to the power source of the vehicle, said piston assembly operationally coupled to said inlet port assembly and said outlet port assembly such that said piston assembly is in fluid communication with said outlet port assembly and said inlet port assembly, said motor member operationally coupled to said piston assembly such that said motor member actuates said piston assembly to draw oil from the oil pan of the vehicle into the disposal container.

3. The oil extraction apparatus as set forth in claim 2 wherein said pump assembly comprises a switch member, said switch member operationally coupled to said motor member such that said switch member is operationally coupled between said motor member and the power source of the vehicle, said switch controlling the flow of power to said motor member when said switch member is actuated by the user.

4. The oil extraction apparatus as set forth in claim 2 wherein said piston assembly comprises a piston member and a cylinder member, said cylinder member coupled to said outlet port assembly and said inlet port assembly such that said cylinder member is in fluid communication with said outlet port assembly and said inlet port assembly, said piston member slidably positioned in said cylinder member, said piston member operationally coupled to said motor member such that said motor member oscillates said piston member along said length if said cylinder member, said piston member creating a vacuum in said cylinder member to draw the oil through said inlet port assembly and force the oil through said outlet port assembly during an oscillation of said piston member.

5. The oil extraction apparatus as set forth in claim 4 wherein said piston member comprises a head portion and a rod portion, said rod portion operationally coupled to said motor member, said head portion positioned in said cylinder member, said rod portion operationally coupled to said head portion such that said rod portion slides said head portion with respect to said cylinder member when said rod portion is actuated by said motor member.

6. The oil extraction apparatus as set forth in claim 5 wherein said piston member comprises a pair of seal portions, one of said seal portions coupled to said head portion opposite the other one of said seal portions, said seal portions engaging said cylinder member to inhibit oil leaking around said head portion of said piston member when the oil is drawn through said inlet port assembly and expelled through said outlet port assembly.

7. The oil extraction apparatus as set forth in claim 4, further wherein a gasket member is selectively positioned between said cylinder member, said outlet port assembly and said inlet port assembly when said cylinder member is coupled to said inlet port assembly and said outlet port assembly, said gasket member inhibiting oil from leaking out of said cylinder member between said cylinder member, said outlet port assembly and said inlet port assembly.

8. The oil extraction apparatus as set forth in claim 1 wherein said inlet port assembly comprises an inlet nipple portion and an inlet conduit, said inlet conduit selectively coupled to said inlet nipple portion, said inlet conduit insertable into the oil pan of the vehicle through an oil dipstick tube of the vehicle such that said inlet conduit allows oil from the oil pan to be drawn into said inlet nipple portion.

9. The oil extraction apparatus as set forth in claim 8 wherein said inlet valve member is positioned adjacent said inlet nipple portion.

10. The oil extraction apparatus as set forth in claim 9 wherein said inlet valve member comprises an inlet seal member and an inlet biasing member, said inlet biasing member biases said inlet seal member against said inlet nipple portion to inhibit oil from flowing through said inlet nipple portion when said pump assembly is expelling oil through said outlet port assembly, said inlet seal member forced away from said inlet nipple portion to allow oil to flow through said inlet nipple portion from the oil pan of the vehicle when said pump assembly is drawing oil from the oil pan of the vehicle.

11. The oil extraction apparatus as set forth in claim 1 wherein said outlet port assembly comprises an outlet nipple portion and an outlet conduit, said outlet conduit selectively coupled to said outlet nipple portion, said outlet conduit insertable into the disposal container such that said outlet conduit allows oil from the oil pan to be expelled into the disposal container through said outlet nipple portion.

12. The oil extraction apparatus as set forth in claim 11 wherein said outlet valve member is positioned adjacent said outlet nipple portion.

13. The oil extraction apparatus as set forth in claim 12 wherein said outlet valve member comprises an outlet seal member and an outlet biasing member, an outlet aperture of said outlet port assembly positioned between said outlet nipple portion and said pump assembly to permit fluid communication between said pump assembly and said outlet nipple portion, said outlet biasing member biases said outlet seal member against said outlet aperture of said outlet port assembly to inhibit oil from flowing through said outlet nipple portion when said pump assembly is drawing oil through said inlet port assembly, said outlet seal member forced away from said outlet aperture to allow oil to flow through said outlet nipple portion to the disposal container when said pump assembly is expelling oil drawn from the oil pan of the vehicle.

14. An oil extraction apparatus for extracting oil from an engine, the oil extraction apparatus comprising a pump assembly operationally coupled to a power source of a vehicle such that the power source supplies power to said pump assembly to actuate said pump assembly, an inlet port assembly operationally coupled to said pump assembly such that said pump assembly is in fluid communication with said inlet port assembly, said inlet port assembly in fluid communication with an oil pan of the vehicle, said pump assembly drawing oil from the oil pan of the vehicle through said inlet port assembly when said pump assembly is actuated, an outlet port assembly operationally coupled to said pump assembly such that said pump assembly is in fluid communication with said outlet port assembly, said outlet port assembly in fluid communication with a disposal container, said pump assembly forcing oil drawn through said inlet port assembly through said outlet port assembly to be deposited in the disposal container for disposal of the oil, wherein said pump assembly comprises a motor member and a piston assembly, said motor member operationally coupled to the power source of the vehicle, said piston assembly operationally coupled to said inlet port assembly and said outlet port assembly such that said piston assembly is in fluid communication with said outlet port assembly and said inlet port assembly, said motor member operationally coupled to said piston assembly such that said motor member actuates said piston assembly to draw oil from the oil pan of the vehicle into the disposal container, wherein said pump assembly comprises a switch member, said switch member operationally coupled to said motor member such that said switch member is operationally coupled between said motor member and the power source of the vehicle, said switch controlling the flow of power to said motor member when said switch member is actuated by the user, wherein said piston assembly comprises a piston member and a cylinder member, said cylinder member coupled to said outlet port assembly and said inlet port assembly such that said cylinder member is in fluid communication with said outlet port assembly and said inlet port assembly, said piston member slidably positioned in said cylinder member, said piston member operationally coupled to said motor member such that said motor member oscillates said piston member along said length if said cylinder member, said piston member creating a vacuum in said cylinder member to draw the oil through said inlet port assembly and force the oil through said outlet port assembly during an oscillation of said piston member, wherein said piston member comprises a head portion and a rod portion, said rod portion operationally coupled to said motor member, said head portion positioned in said cylinder member, said rod portion operationally coupled to said head portion such that said rod portion slides said head portion with respect to said cylinder member when said rod portion is actuated by said motor member, wherein said piston member comprises a pair of seal portions, one of said seal portions coupled to said head portion opposite the other one of said seal portions, said seal portions engaging said cylinder member to inhibit oil leaking around said head portion of said piston member when the oil is drawn through said inlet port assembly and expelled through said outlet port assembly, wherein a gasket member selectively positioned between said cylinder member, said outlet port assembly and said inlet port assembly when said cylinder member is coupled to said inlet port assembly and said outlet port assembly, said gasket member inhibiting oil from leaking out of said cylinder member between said cylinder member, said outlet port assembly and said inlet port assembly, wherein said inlet port assembly comprises an inlet nipple portion and an inlet conduit, said inlet conduit selectively coupled to said inlet nipple portion, said inlet conduit insertable into the oil pan of the vehicle through an oil dipstick tube of the vehicle such that said inlet conduit allows oil from the oil pan to be drawn into said inlet nipple portion, wherein said inlet port assembly comprises an inlet valve member positioned adjacent said inlet nipple portion, said inlet valve member restricting oil drawn through said inlet nipple portion when said pump assembly is forcing oil through said outlet port assembly, said inlet valve permitting oil to be drawn through said inlet nipple portion when said pump assembly is drawing oil from the oil pan of the vehicle, wherein said inlet valve member comprises an inlet seal member and an inlet biasing member, said inlet biasing member biases said inlet seal member against said inlet nipple portion to inhibit oil from flowing through said inlet nipple portion when said pump assembly is expelling oil through said outlet port assembly, said inlet seal member forced away from said inlet nipple portion to allow oil to flow through said inlet nipple portion from the oil pan of the vehicle when said pump assembly is drawing oil from the oil pan of the vehicle, wherein said outlet port assembly comprises an outlet nipple portion and an outlet conduit, said outlet conduit selectively coupled to said outlet nipple portion, said outlet conduit insertable into the disposal container such that said outlet conduit allows oil from the oil pan to be expelled into the disposal container through said outlet nipple portion, wherein said outlet port assembly comprises an outlet valve member positioned adjacent said outlet nipple portion, said outlet valve member restricting oil expelled through said outlet nipple portion when said pump assembly is drawing oil through said inlet port assembly, said outlet valve permitting oil to be expelled through said outlet nipple portion when said pump assembly is expelling oil from said pump assembly, and wherein said outlet valve member comprises an outlet seal member and an outlet biasing member, an outlet aperture of said outlet port assembly positioned between said outlet nipple portion and said pump assembly to permit fluid communication between said pump assembly and said outlet nipple portion, said outlet biasing member biases said outlet seal member against said outlet aperture of said outlet port assembly to inhibit oil from flowing through said outlet nipple portion when said pump assembly is drawing oil through said inlet port assembly, said outlet seal member forced away from said outlet aperture to allow oil to flow through said outlet nipple portion to the disposal container when said pump assembly is expelling oil drawn from the oil pan of the vehicle, wherein both the inlet valve member and the outlet valve member have a trapezoidal cross-sectional configuration.

* * * * *